US006402277B1

(12) United States Patent
Monclús et al.

(10) Patent No.: US 6,402,277 B1
(45) Date of Patent: Jun. 11, 2002

(54) INK LEAK DETECTION SYSTEM IN INKJET PRINTING DEVICES

(75) Inventors: Antonio Monclús; Sergio de Santiago; Xavier Gasso, all of Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/495,035

(22) Filed: Jan. 31, 2000

(51) Int. Cl.[7] ..... B41J 2/175
(52) U.S. Cl. ..... 347/7; 347/85
(58) Field of Search ..... 347/7, 36, 85, 347/86, 87; 355/256

(56) References Cited

U.S. PATENT DOCUMENTS 4,994,860 A * 2/1991 Lunde et al. ..... 355/256
5,023,629 A * 6/1991 Kiyohara ..... 347/36
5,877,793 A * 3/1999 Erickson ..... 347/85

FOREIGN PATENT DOCUMENTS

EP 0 863 016 9/1998 ..... B41J/2/175
JP 1-174460 * 12/1987 ..... 347/36
JP 3-247462 A * 11/1991 ..... 347/36

* cited by examiner

*Primary Examiner*—Anh T. N. Vo

(57) ABSTRACT

An inkjet printing device has a frame, a transversely moveable printhead carriage, carrying a plurality of inkjet printheads, mounted for reciprocating movement on the frame, ink supply reservoirs mounted on the frame and flexible ink supply tubes for delivering ink from each of the ink reservoirs to a corresponding inkjet printhead. The device further includes an ink leakage detection system with an ink collector for collecting an ink leak from the ink supply tubes, and a sensing circuit coupled to the collecting unit, capable of detecting the presence of ink in the ink collector. A method of detecting the ink leak in the inkjet printing device includes the step of: conveying the ink leak from an ink delivery system to the ink collector, both comprised by the inkjet printing device; sensing when the ink is present in the ink collector; providing the information that an ink leakage is present in the device; and stopping the device.

16 Claims, 8 Drawing Sheets

80
12
16
14
10
20
22
24
26

INK LEAK DETECTION SYSTEM IN INKJET PRINTING DEVICES

BACKGROUND OF THE INVENTION AND PRIOR ART

The present invention relates to the art of computer driven inkjet printing devices, like ink jet printers, multi-function printing/scanning devices, faxes, copiers or the like. Devices of this type have a printhead carriage which is mounted for reciprocal movement on the device in a direction orthogonal to the direction of movement of the paper or other medium on which printing is to take place through the device. For sake of simplicity, in the following we refer to an inkjet printer only, but the same will apply to any inkjet printing devices, mutatis mutandis. The printer carriage of a printer typically has from one to four or more ink jet printheads mounted thereon, e.g. piezoelectric or thermal printhead. Each of the printheads contains a supply of ink which, for large scale printers, is generally inadequate due to the large volumes of ink which are required as compared with the ink supply requirements of desk top printers. Consequently, various means have been proposed for continuously or periodically refilling the carriage-borne printheads with ink. These systems fall into two categories. The first comprises off-board or off-axis ink reservoirs which are continuously connected to the carriage-borne or onboard printheads by flexible tubes. The second comprises a "take a gulp" system in which the printhead carriage is periodically moved to one end of its path of travel where it is then connected with off-axis ink reservoirs to fill the onboard printheads. This "take a gulp" system is disclosed in Hewlett-Packard's Designjet 2000 printer referred to in U.S. patent application Ser. No. 08/805,861 filed Mar. 3, 1997 and published in European Patent Publication No. 0863016 on Sep. 9, 1998.

Large format printers are expensive pieces of equipment which preferably should be capable of using different types of ink without significant modification of the printer. The different ink types may for convenience be broadly referred to as indoor ink and outdoor ink, meaning ink intended to be used for production of drawings, posters, and other printed material which may be displayed outdoors or indoors. Outdoor ink is pigment based, i.e. containing a plurality of discrete undissolved pigment particles suspended in a fluid carrier. Dye-based ink has a lower degree of optical density and permanence but is less expensive.

Further, in color printers four separate colors of ink are usually employed comprising black and three primary or mid-primary colors such as cyan, magenta and yellow. In color ink printers provision must also be made to ensure that neither incorrect types of ink nor incorrect colors of ink can inadvertently be used in the system.

Since the ink delivery tubes connected from off-board reservoirs to onboard printheads continually flex, leakage and breakage of the ink supply tubes is experienced. A reliable ink delivery system and guides for routing the ink delivery tubes to minimize flexing and breakage is desired.

U.S. patent application Ser. No. 09/240,091 filed on Jan. 29, 1999 describes a more reliable ink delivery system wherein the ink delivery tubes, thanks to a minimized flexing and breakage, provides the system with a longer expected lifetime. However, because of the tube routing , the tubes are continuously stressed to flexure. When the carriage moves back and forth along the scan axis the ink delivery tubes are stressed and also move causing fatigue. It turns into a life or maximum number of cycles that the tubes can make. When the tubes reach the end of them life, they can break due to fatigue. In addition, even if the flexing has been minimized, some infant failures can happen before their end of life.

If any of the tubes break, there is an ink leak through it. As a result, the printer may get damaged: as it is not controlled, the ink can get over the paper axis or the scan axis or even reach the electronics burning it. It is also possible that the ink gets out of the printer, reaching the user or the floor.

A possible solution to prevent the printer from getting damaged if a ink delivery tube is broken is to have a tube carrier enclosing it and completely sealed to be used as a secondary containment. So, if ink delivery tubes break, the ink gets contained between the ink delivery tube and the tube carrier, and it cannot damage the printer. However this solution still has some disadvantages. For instance, when the tubes break, there is an initial small crack that begins to grow. When the crack is big enough, the tube can kink and get completely broken, and its sharp edges can perforate the tube carrier. So, even if the tube carrier is well sealed it can be perforated by the broken tubes causing an ink leak over the scan axis. Moreover, it is more difficult to design and implement an easy-to-assemble plug system to seal the two ends of the tube carrier.

Applicant then realized that many of the above problems may be reduced by detecting the leakage when the crack has just begun.

In any case, since an ink leakage implies a major damage for the printer, an ink leak containment and detection system which detects and contains the leakage and preferably stops the printers, before a gross leak damage occurs, is desired.

SUMMARY OF THE INVENTION

The present invention provides an inkjet printing device having a frame, a transversely moveable printhead carriage, carrying at least one inkjet printhead, mounted for reciprocating movement on said frame, ink supply reservoir means mounted on said frame and flexible ink supply tubing for delivering ink from said ink reservoir means to said at least one inkjet printhead, said device further comprising an ink leakage detection system comprising:

- a collecting unit, for collecting the ink leaked from the ink supply tubing; and
- a sensing circuit coupled to said collecting unit, capable of detecting the presence of ink in said collecting unit.

The presence of a sensing circuit gives more benefits than a simple double containment since it can be used to warn the user to replace the tubes as soon as they break, reducing the risk of damaging the printer.

In addition the device further comprises an ink carrier, for conveying the leaked ink into the collecting unit. The ink carrier comprises additional tubing, having apertures at a first end and at a second end, coaxially containing said flexible ink supply tubing to bound so said flexible ink supply tubing, wherein the aperture at the first end of said additional tubing is sealed.

Accordingly, a manufacture may obtain an additional advantage since it is easier to design an easy-to-assemble plug system to seal just one end of the additional tubing than to seal the two ends as in a simple double containment system, and it can detect the leak in time before the tube breaks completely, reducing the risk of perforating the tube carrier.

Moreover if the tubes break, it avoids gross damage of the printer or to spread ink around, in particular on the user. This also improves the replaceability and serviceability of the ink delivery system: if the tubes break it is simpler to change the ink delivery system. In addition, this leak detection system can also work for any length of printer, and it is particularly simple and easy to implement.

The present invention further provides an inkjet printing device having a frame, a transversely moveable printhead carriage, carrying at least one inkjet printhead, mounted for reciprocating movement on said frame, ink supply reservoir means mounted on said frame and flexible tubing means for delivering ink from said ink reservoir means to said at least one inkjet printhead, said device further comprising an ink leakage detection system comprising:

collecting means, for collecting the ink leaked from the ink supply tubing; and sensing means coupled to said collecting means, capable of detecting the presence of ink in said collecting means.

In accordance to a different aspect of the present invention there is provided a method of detecting an ink leak in an inkjet printing device comprising the step of:

a) conveying the ink leak from an ink delivery system to an ink collector;

b) sensing when ink is present in the ink collector c) providing the information that an ink leakage is present in the device.

In accordance to a further different aspect of the present invention there is provided a method of detecting an ink leak in an inkjet printing device comprising the step of:

a) conveying the ink leak from an ink delivery system to an ink collector;

b) sensing when ink is present in the ink collector;

c) providing the information that an ink leakage is present in the device;

d) stopping the device.

DESCRIPTION OF THE PREFERRED EMBODIMENT

Figure 1:
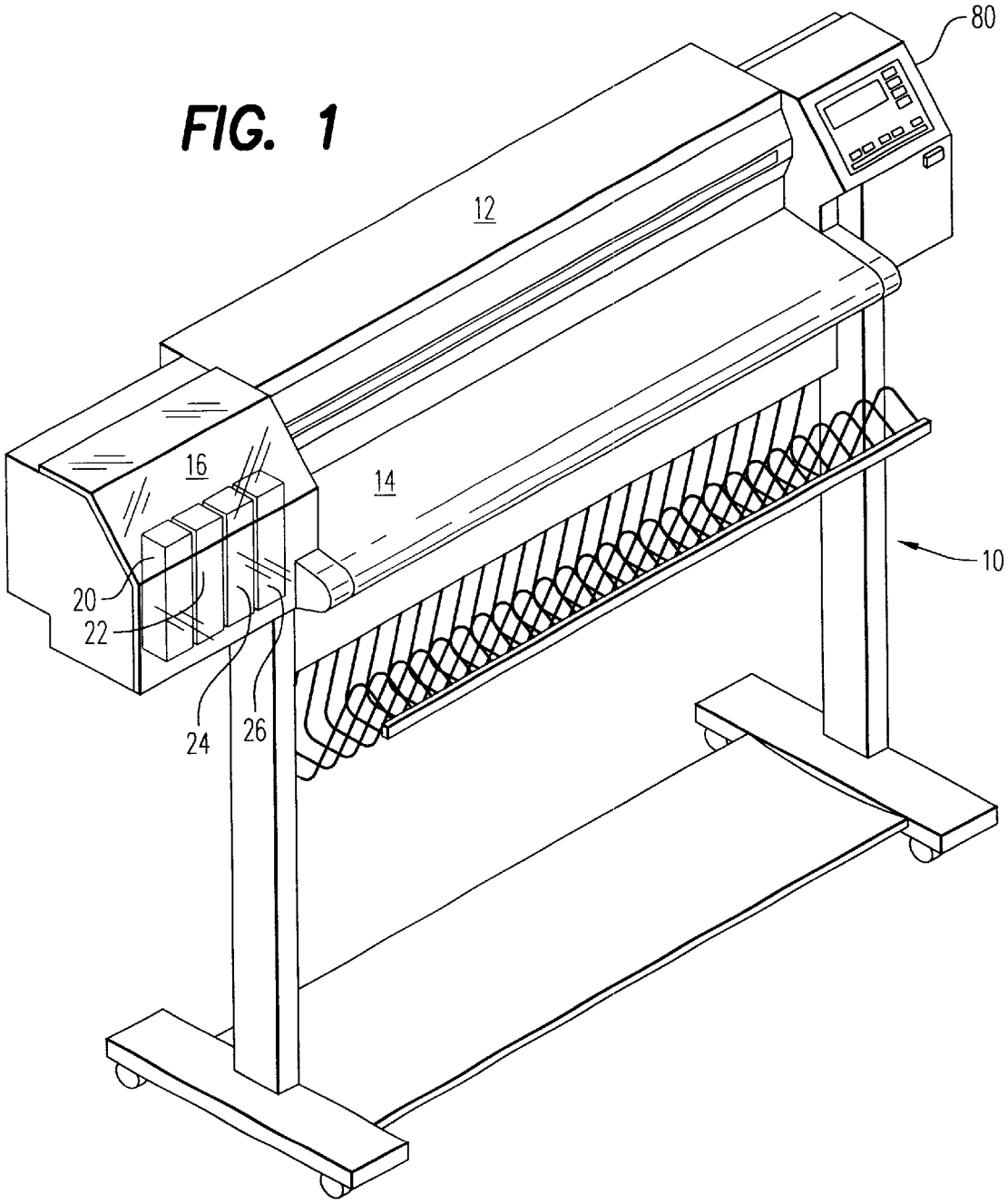
FIG. 1 is a perspective view of a large format printer in which the present invention is useful.

FIG. 1 shows a large format printer 10 of the type which includes a transversely movable printhead carriage enclosed by a plastic or metal hinged cover 12 which extends over a generally horizontally extending platen 14 over which printed media is discharged. At the left side of the platen is a transparent hinged cover 16 which contains four removable ink reservoirs 20, 22, 24, 26 which, through a flexible tube arrangement, supply ink to four inkjet printheads mounted on the moveable carriage.

Figure 2:
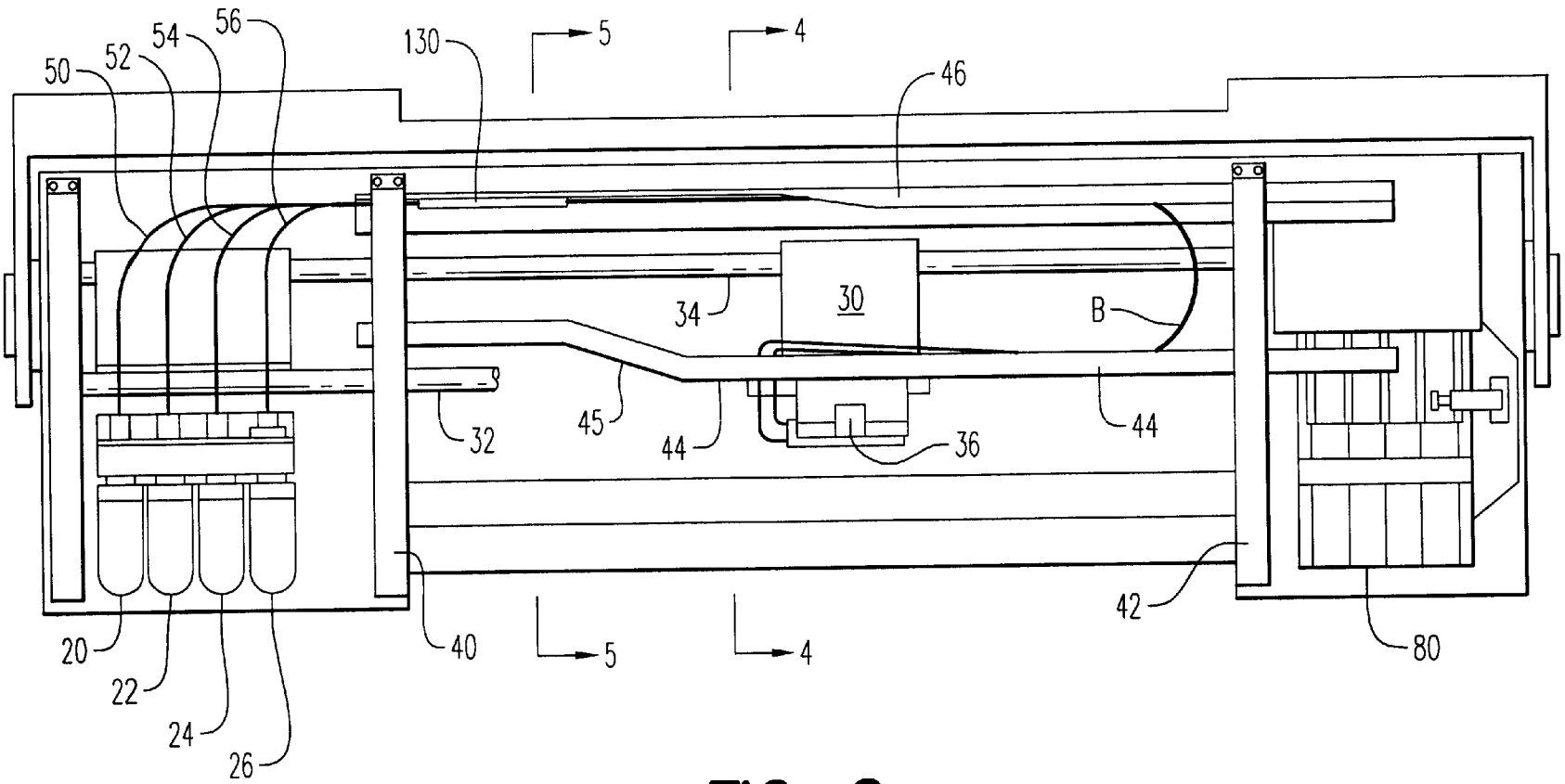
FIG. 2 is a top plan view of the printer with its cover removed to show the printhead carriage and ink tube guides and supports.

In the plan view of FIG. 2 in which the carriage cover 12 has been removed, it is seen that the printhead carriage 30 is mounted on a pair of transversely extending slider rods or guides 32, 34 which in turn are rigidly affixed to the frame of the printer. Also rigidly affixed to the frame of the printer are a pair of tube guide support bridges 40, 42 from which front and rear tube guides 44, 46 are suspended. The front tube guide 44 has end portions which extend transversely of the printer and an intermediate section 45 which is angled in a horizontal plane near the left bridge support 40 to provide a clearance area for opening a printhead holddown cover 36 on the carriage 30 when the carriage is slid to a position proximate the left side of the platen 14 so that the printhead holddown cover 36 can be easily opened for changing the printheads.

A flexible ink delivery tube system conveys ink from the four separate ink reservoirs 20, 22, 24, 26 at the left side of the printer through four flexible ink tubes 50, 52, 54, 56 which extend from an ink reservoirs through the rear and front tube guides 44, 46 to the carriage 30 to convey ink to four printheads on the carriage 30. The ink tube delivery system may be a replaceable system as described and claimed in co-pending application Ser. No. 09/240,039 filed on Jan. 29, 1999 owned by the assignee of the present invention, the disclosure of which is hereby incorporated herein by reference. The ink is delivered from an ink reservoir to the corresponding printhead by means of an air pressurized system, which by priming air into the reservoir, applies pressure to the ink contained in it, so conveying the ink out of the reservoir through the tube and up the printhead.

At the right side of the printer is a printhead service station 80 at which the printhead carriage 30 may be parked for servicing such as wiping, spitting or priming the printheads.

Figure 3:
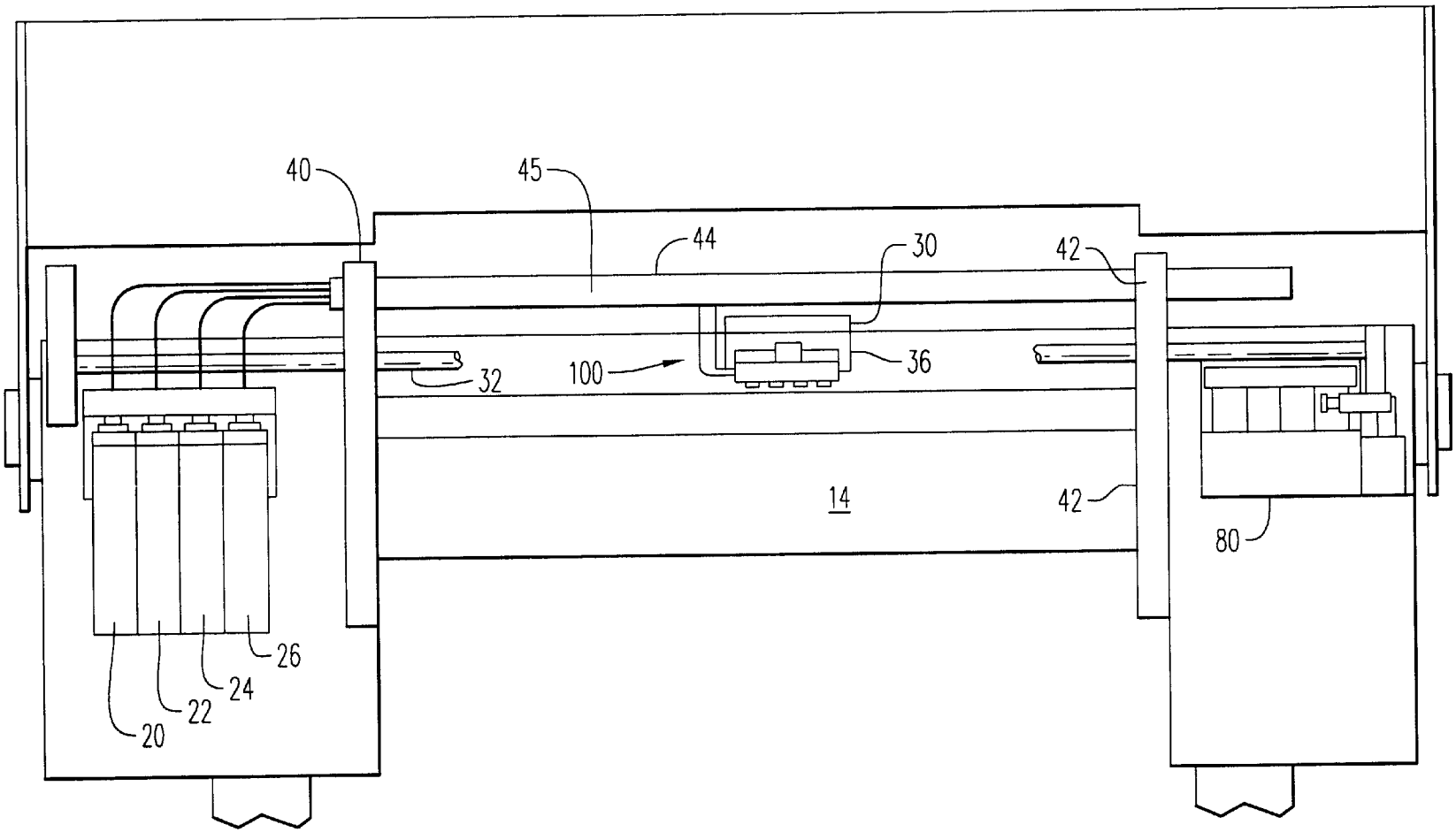
FIG. 3 is a front elevation view of the upper portion of the printer with cover removed to show the printhead carriage and attached printhead connector tubes.

As seen in FIG. 3, each of the four ink reservoirs 20, 22, 24, 26 is easily accessible from the front of the printer when the reservoir cover 16 (seen in FIG. 1) is open so that the reservoirs can be easily removed to be refilled or replaced with new reservoirs. As is known in the art, three of the reservoirs each contain a different base color of ink such as cyan, magenta and yellow and the fourth reservoir contains black ink so that a high number of colors can be produced as desired during printing.

Figure 4:
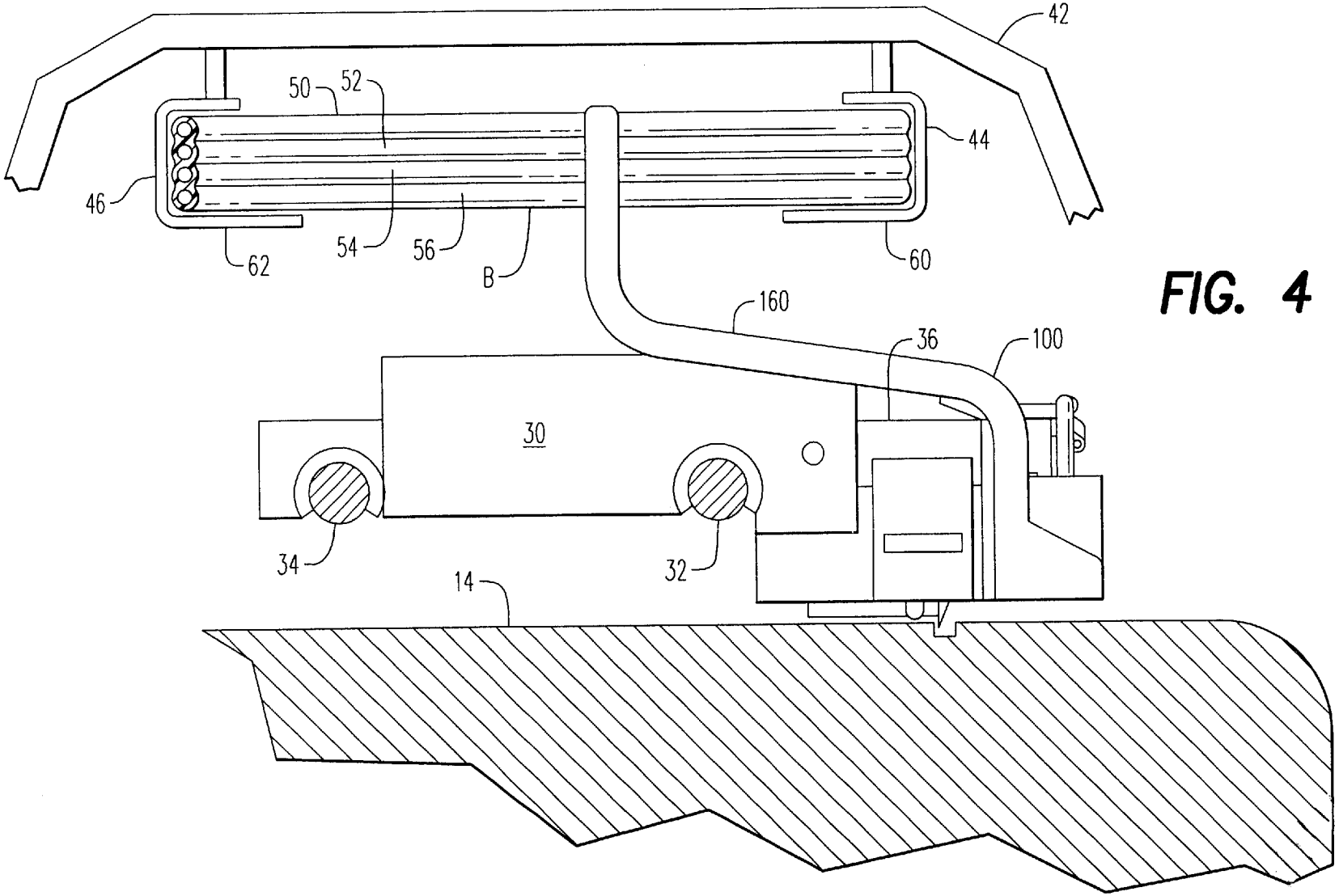
FIG. 4 is a vertical cross-section taken at line 4—4 on FIG. 2 through the relevant portions of the printer showing the relative position of the carriage, the tube guide system and the ink delivery tubes with a printhead holddown cover on the carriage in its closed position.
Figure 5:
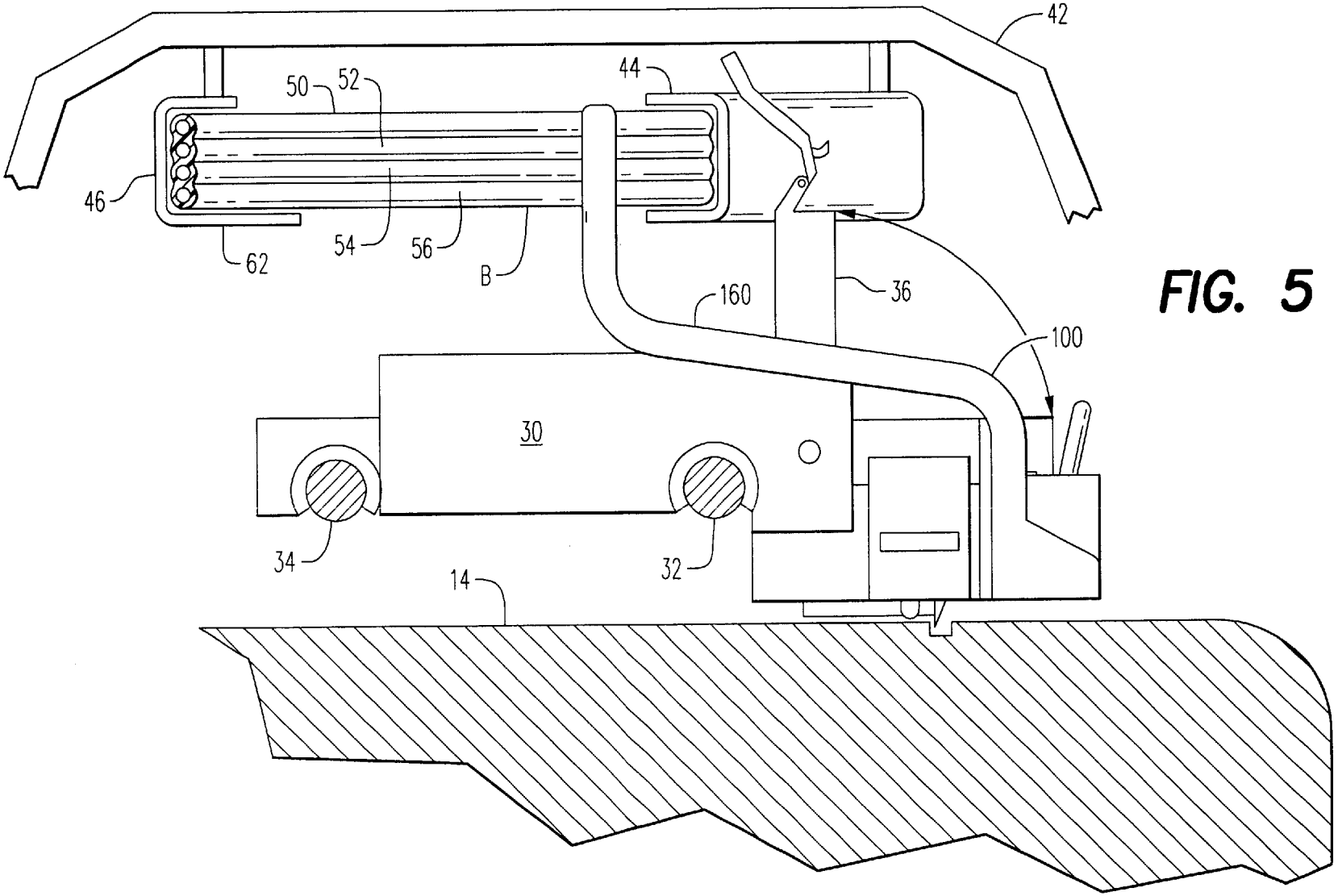
FIG. 5 is a vertical cross-section taken at line 5—5 on FIG. 2 through the relevant portions of the printer showing the relative position of the carriage, the tube guide system and the ink delivery tubes with the printhead holddown cover in its open or raised position.

As best seen in FIGS. 4 and 5, the front and rear tube guides 44, 46 are of channel configuration with each guide 44, 46 having a lower flange 60, 62 which provides a support surface which extends in a common horizontal plane for supporting the ink delivery tubes 50, 52, 54, 56 along its length with the exception of the reverse bend B (FIG. 2) in the tubes to the right of the printer carriage 30. The ink tubes are preferably bound together in a flexible wear resistant low friction sheath 58 to confine the tubes in a vertical plane and prevent wear as the tubes move in the guides 44, 46. The tube bundle and sheath is of sufficient rigidity to be self supporting in the region of the reverse bend B.

Figures 8A, 9:
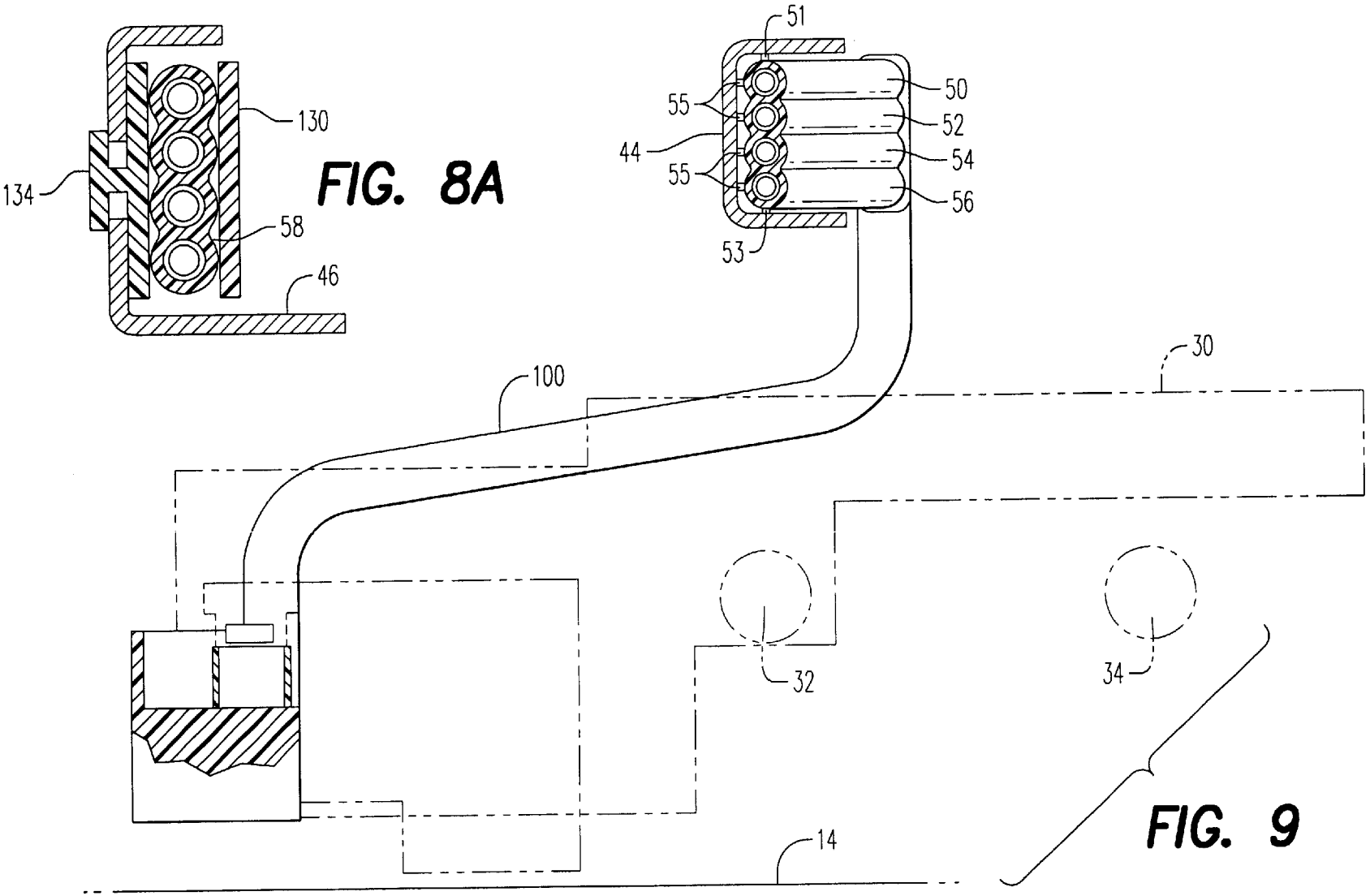
FIG. 9 is a right side elevation of a carriage connector and an ink tube support.

The flexible ink delivery tubes 50, 52, 54, 56 and sheath are all permanently connected to a printhead connector 100 which is a relatively rigid plastic part best seen in FIGS. 4 and 9. The ink delivery tubes are preferably made of a linear low density polyethylene. The protective sheath 58 encloses the flexible ink tubes between their permanent connection to the printhead connector 100 and a rigid plastic tube clip 130 which fastens the ink tubes to the rear tube guide 46 at the location shown in FIG. 2 near the left side of the printer. The protective sheath 58 preferably includes wear resistant lubricious ribs 51, 53 on the top of the upper tube 50 and on the bottom of the lower tube 56 and ribs 55 on the sides of all four tubes 50, 52, 54, 56 which face the front and rear tube guides 44, 46. The ribs 51, 53, 55 are preferably made from polypropylene containing about 5% aramid fibers and 20% polytetrafluoroethuylene (TEFLON). The material of the sheath 58 is preferably a polypropylene and EPOM compound which is both flexible and fatigue resistant. The above combination of materials for the sheath and ribs has been found to be considerably more quiet than prior art flexible ink delivery systems.

Apertures 70, 72 having elongated slots 74, 76 in the vertical wall of the rear tube guide 46 receive mating bayonet clips 132, 134 on the rear side of the tube clip 130 so that the tube clip may be slid to the right or the left to easily connect or disconnect the clip 130 from the rear tube guide 46.

The lower tube support flange 60 of the front tube guide 44 is shown in a generally horizontal plane in FIG. 4 but a slight downward inclination of the flange toward the opposite flange 62 of the rear tube guide 46 is desirable to assist in smooth movement of the tube bundle in the front guide. Comparison of FIGS. 4 and 5 shows that the lower flange 60 is slightly downwardly inclined in the FIG. 4 view but is somewhat horizontally shorter and is horizontally oriented in the FIG. 5 view. Reduction in the horizontal length of the support flange 60 as seen in FIG. 5 enables the printhead connector 100 and attached tubes to pass to the side of the flange 60 in the region of the left transversely extending section of the front tube guide 44. Also as seen in FIGS. 2, 4 and 5, the rear tube guide has an upper flange which extends substantially along the right half of the rear tube guide 46, the top flange gradually terminating at an angled section centrally located on the printer. It will be appreciated that there is no relative motion between the rear tube guide and the tubes in the section which is uncovered by the top flange. Similarly, the short section of tubes and sheath extending from the permanent connection to the printhead connector 100 to the lower flange 60 of the front tube guide 44 need not be supported by the lower flanged 60 since the tubes and sheath are self supporting for short lengths in this area and at the reverse bend B of the tubes.

Figure 7:
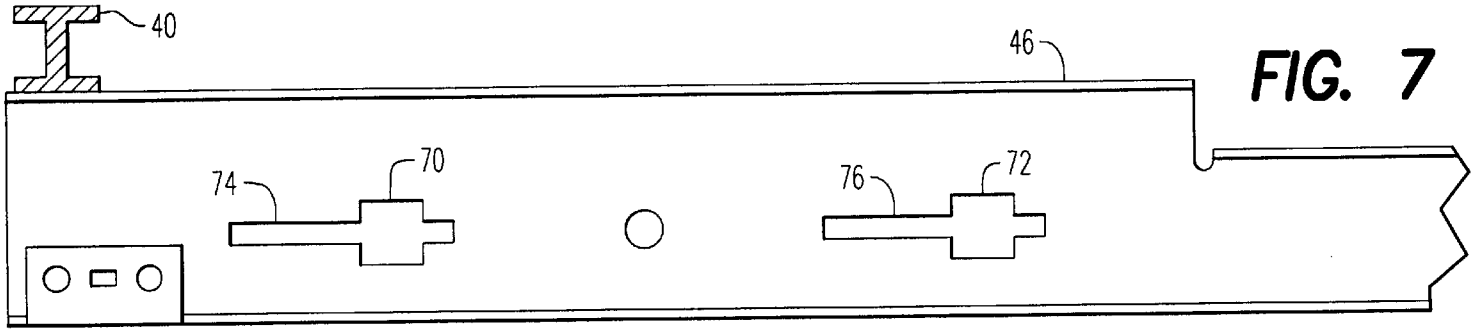
FIG. 7 is a partial front elevation view of the rear tube guide with the tube clip and tubes removed.
Figure 6:
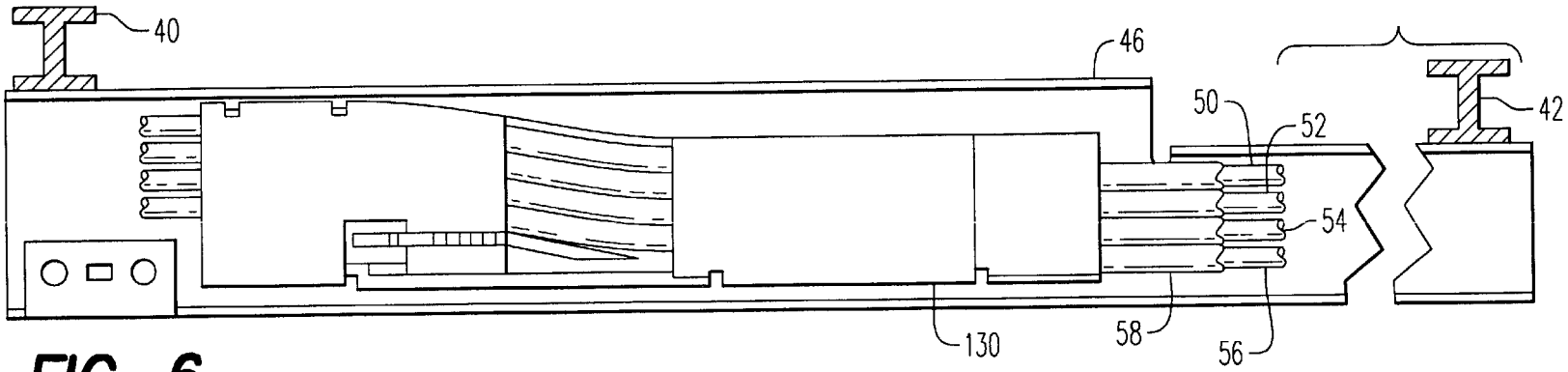
FIG. 6 is a partial front elevation of the rear tube guide and a tube clip partly broken away to show internal construction, fastening the ink tubes to the rear tube guide.
Figure 8:
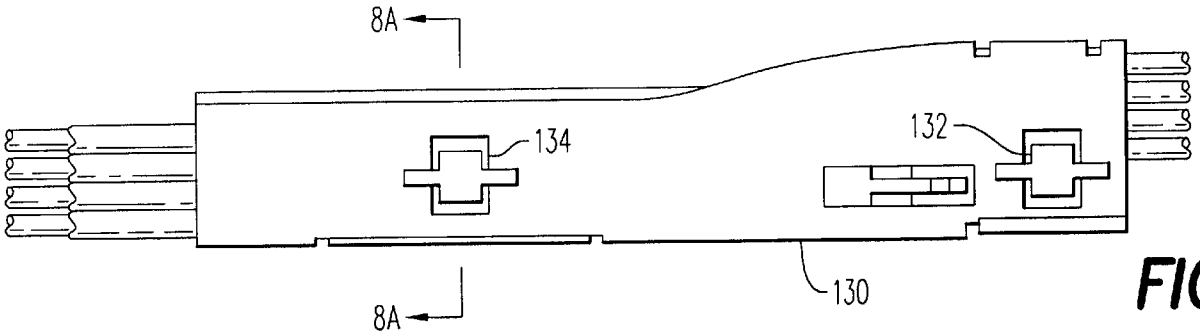
FIG. 8 is a rear elevation view of the tube clip, FIG. 8A being an enlarged cross-section at line 8A—8A of FIG. 8.

An ink tube clip 130 (FIGS. 6–8) comprises a molded plastic part having four parallel tube channels formed therein. The sheath terminates near the right end of the tube guide 130 and the four ink delivery tubes 50, 52, 54, 56 extend continuously through the channels in the guide 130 to emerge from the left edge of the guide. The guide is provided with foldable upper and lower closure flaps integrally formed with the rear channel-defining wall of the clip 130 and are connected thereto by flexible hinge sections and connectors having inherent resilience so that the doors may be closed over the ink delivery tubes and sheath, the tubes being confined in their respective channels. A resilient hook in the rear wall of the clip 130 engages an aperture in the upper flap to close the flap over the ink delivery tubes. An engagement lip at the lower edge of the rear wall of the clip 130 mates with a complementary hook on the lower edge of the upper flap to securely fasten the flap head hold and hold the tubes in place. A front flap is similarly constructed with a flexible hinge joining it to the channel defining wall of the clip 130. Complementary hooks on the upper right edge of the channel defining wall of the clip 130 and upper edge of the lower flap securely hold the flap in place to confine the tubes and sheath at the right end of the clip 130.

The rear side of the clip has integrally molded fasteners thereon which are received in complementary shaped slotted apertures in the vertically extending wall of the rear tube guide as shown.

Figure 10:
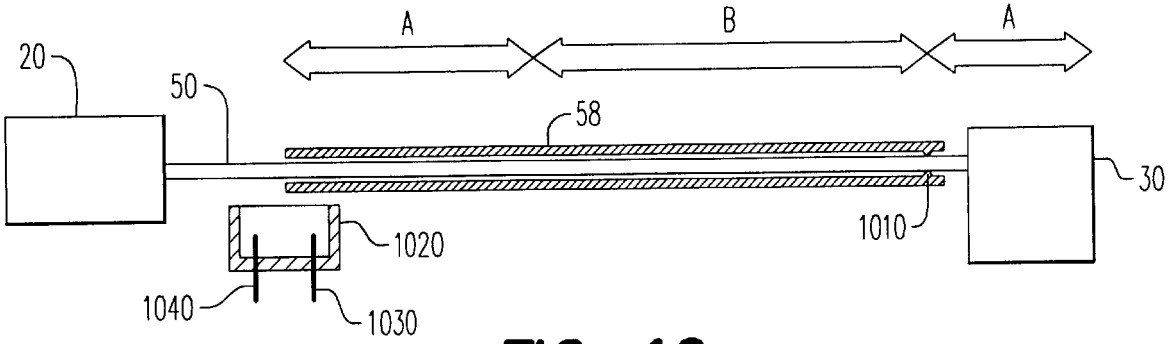
FIG. 10 is a schematic vertical cross-section through the relevant portions of the printer showing the relative positions of the carriage, the ink delivery tubes and the ink leakage system.

With reference to FIG. 10, the mechanical part of the ink leak detector will now be described. As it has been said above, the ink delivery system comprises four flexible ink delivery tubes 50, 52, 54, 56, but for sake of clarity the ink leak detector will be described with reference to just one of them, since the same applies to remaining ones.

When tube 50 breaks, a small crack appears. It more likely to happen in the dynamic zone B of the tube, which is the part that is subject to the reverse bend during the carriage movement. Zones A of tube 50 are the portions that are substantially static while the carriage 30 is moving. As the system is pressurized, the ink is forced to flow through the crack and gets between the tube 50 and the tube sheath 58, filling it.

The carriage end of the tube sheath 58 is sealed with an O-ring 1010 that has been preferably overmolded to the tube sheath itself. This joint 101 prevents the ink from reaching the carriage 30.

As one end of the tube 50 is plugged the ink is forced by the pressure, to flow towards the other, opened, end, which is fixed to the printer 10. In correspondence to the open end of the tube sheath 58, at a lower position, it is placed an ink collector 1020, that retains the ink as it drops from the tube sheath 58 by gravity.

The ink collector 1020 comprises two metallic pins or electrodes 1030, 1040, triggering the electrical resistance between them. When the ink gets into contact with the pins (and taking advantage of the conductive properties of the ink) the electrical resistance gets reduced, and the ink leak is detected.

When the leak is detected, the printer 10 preferably stops printing and the pump pressurizing the ink into the tube 50 is turned off. So, the system gets depressurized, and the ink in the tubes returns, by gravity, to the ink reservoir 20. If the user turns off and on the printer, the system continues triggering the resistance and by detecting the leak, stops the printer again immediately.

A System Error message may also displayed on the front panel, advising the user to replace the tubes, or to call the service support.

The above described ink leak detection system can be easily applied to a preferred embodiment wherein four ink delivery tubes are employed, as described with reference to FIGS. 1 to 9, and a single tube sheath 50 is provided for enclosing all the four ink delivery tubes 50, 52, 54, 56. By sealing the carriage end of the tube sheath 50, by means of four O-rings, one per each ink delivery tubes, overmolded to the tube sheath 50, the ink leaked from any of the four ink delivery tubes is conveyed within the tube sheath 50 towards its open end and then into the ink collector 1020.

The skilled in the art may appreciate that in a further embodiment, wherein more ink delivery tubes are employed, e.g. in six or eight color printers, the above system can still be applied, with few changes. For instance the ink delivery tubes may be grouped into independent sets, e.g. 3 tubes and 3 tubes (in a 6 color printer), or 4 tubes and 4 tubes (in a 8 color printer) or any other combination depending on the kind of constraints generated by the printer design, each set being enclosed by an independent tube sheath 50. The two independents tube sheaths may lay side by side and may be guided by a guide system similar to the one described above. In case of leakage, by sealing the carriage end of both the tube sheaths, the ink is, again, conveyed to the open end and then into the same ink collector, this time placed in correspondence of the open ends of both the tube sheaths. As an alternative, two ink collectors may be located within the printer, each one collecting the ink coming from one of the two tube sheaths, so that in case of breakage of ink delivery tube(s) in only one set, the failing ink delivery tube set can be more easily identified and replaced.

Figure 11:
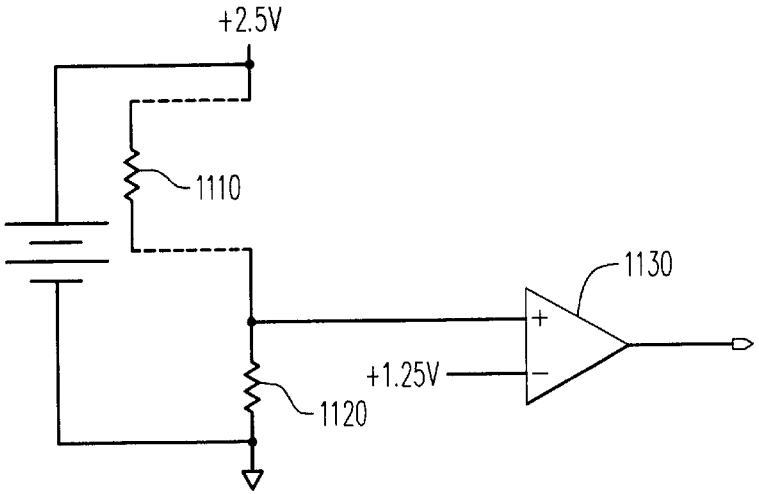
FIG. 11 is a schematic design of an electrical circuit used in the ink leakage system to detect ink leakage in accordance with one embodiment of the present invention.

With reference to FIG. 11, the electrical circuit of the ink leak detection system will be now described. As described above, the tubes system forces the ink to flow towards the ink leak collector 1020 in case of a leakage. In collector 1020, the two electrodes 1030, 1040, being integrated in a resistance divider network, are used to measure the resistance generated by the means which allows an electrical connection between them. In case of no leakage there will be air between the two electrodes and the resistance measured will be very high ($>10^{12}\Omega$). In case of leakage, the collector will contain ink and a potential short circuit between both electrodes is generated through the ink. To summarize, the ink leak detector measures the resistance in the collector, if this resistance is below a certain threshold value then the system will assume there is ink in the collector and the machine is stopped.

In order to distinguish between the resistance of the air ($>10^{12}\Omega$) and the resistance of the ink (more often comprised between 100 KΩ and 1 MΩ) a number of experiments has been performed by the Applicant. An approximation of the ink resistance indicates that the resistance measured will be around tenths of kilo ohms.

The resistance between both electrodes depends a lot on parameters like the contacts material, the ink resistance, the amount of ink covering the leads, the path the current has between both and so on. As an approximation we could consider that the resistance is caused by a right section of ink between the electrodes, then according to the present example, when there is 3 cc of ink in the collector, the length of electrodes covered by ink is 3.6 mm, then the resistance can be calculated by means of the following formula:

$$R = \frac{1}{\sigma} \cdot \frac{l}{A} \cdot \eta$$

where σ is the ink conductivity, for the nominal case ink (the value assumed is 1 milioh/cm), 1 is the distance between electrodes 1030 ,1040, in this example equal to 12 mm. A is the surface section of one electrode in contact with the ink, in this example 0.7 is the width of each electrode. Finally η is a correction factor (due to several factors like the real value of the conductivity for each ink, the real surface contact, etc). Therefore:

$$\sigma = 10^{-3} mhos/\text{cm}$$

$$l = 1.2\,\text{cm}$$

$$A = 0.07\,\text{cm} \cdot 0.38\,\text{cm} = 0.0266\,\text{cm}^2$$

$$R = \frac{1}{10^{-3}} \cdot \frac{1.2 \cdot \eta}{0.0266} \approx 31\,K\Omega \cdot \eta$$

From statistical measurements done by the Applicant the value of the correction factor is comprises between 8 and 20 for the black ink and 4 to 10 for the colors ink, that's the resistance value is preferably below 1 MΩ for most of the types of ink. The air resistance is always higher than this value for the specific mechanic design (electrodes distance about 12 mm and electrodes length about 20 mm) even in worse case conditions (maximum relative humidity).

Accordingly, the detection of an ink leak may be carried out by measuring the voltage in a resistance divider network, as shown in FIG. 11, composed by the collector resistance 1110, corresponding to the interaction of the two electrodes 1030, 1040, and a fixed resistance 1120 of 2 MΩ. The network is supplied at 2.5 V. This voltage is compared using a comparator 1130 with a fixed reference voltage of 1.25 V. When the voltage measured in the fixed resistor 1120 is higher than the reference voltage then the comparator 1130 output will change and a signal to the system is generated.

The circuit above is then placed on a board, located within the printer and connected to the electrodes 1030, 1040 through two connectors on the board itself. These connectors are then protected from humidity and condensation by some conventional insulating resin.

Those skilled in the art may appreciate that the circuit design above may be modified in many ways, e.g. varying the distance between the electrodes or the size of their surface, but the formula for calculating the resistance between the electrodes can still be used as described for determining the appropriate values for the fixed resistance 1120 and for the fixed reference voltage.

While exemplary and preferred embodiments of the invention have been shown and described, it will be appreciated by those skilled in the art that various modification and revision be made without departing from the spirit and scope of the invention as set forth in the following claims.

What is claimed is:

1. An inkjet printing device having a frame, a transversely moveable printhead carriage, carrying at least one inkjet printhead, subject to reciprocating movement on said frame, and ink supply reservoir means mounted on said frame, and flexible ink supply tubing for delivering ink from said ink reservoir means to said at least one inkjet printhead, said device further comprising an ink leakage detection system comprising:

a collecting unit that collects an ink leak from the flexible ink supply tubing;

an ink carrier that conveys the ink leak from said flexible ink supply tubing to said collecting unit; and a sensing circuit coupled to said collecting unit that detects said ink leak from said flexible ink supply tubing.

2. The device of claim 1, wherein the ink carrier comprises additional tubing having apertures at a first end and at a second end, coaxially enclosing the flexible ink supply tubing.

3. The device of claim 2, wherein the aperture at the first end of said additional tubing is sealed.

4. The device of claim 3, wherein the sealed aperture at the first end is closer to said carriage and the aperture at the second end is closer to the ink reservoir means.

5. The device of claim 4, wherein said collecting unit is located within the printer in correspondence with said aperture at the second end.

6. The device of claim 2, wherein said additional tubing comprises more than one tube, each tube coaxially enclosing a subset of said ink delivery tubing.

7. The device of claim 1, wherein said sensing circuit comprises a pair of electrodes placed into the collecting unit.

8. The device of claim 7, wherein said sensing circuit comprises a resistance divider network, measuring a change in a resistance between the electrodes to detect the ink leaked from the flexible ink supply tubing.

9. The device of claim 8, wherein the ink leaked from the ink supply tubing is detected by said sensing circuit when the resistance between the electrodes is less than a given threshold.

10. An inkjet printing device having a frame, a transversely moveable printhead carriage, carrying at least one inkjet printhead, subject to reciprocating movement on said frame, and ink supply reservoir means mounted on said frame, and flexible tubing means for delivering ink from said ink reservoir means to said at least one inkjet printhead, said device further comprising an ink leakage detection system comprising:

collecting means that collects an ink leak from the flexible tubing means, ink carrier means that conveys the ink leak from said flexible tubing means to said collecting means; and sensing means coupled to said collecting means that detects said ink leak from said flexible tubing means.

11. A method of detecting an ink leak in an inkjet printing device having an ink delivery system for delivering ink from ink reservoir means to printing means, and an ink collector, comprising the steps of:

b) conveying the ink leaked from the ink delivery system to the ink collector by an ink carrier;

c) sensing when ink is present in the ink collector; and c) providing an indication that the ink delivery system has the ink leak.

12. The method of claim 11, wherein said step of providing the indication that the ink delivery system has an ink leak further comprises the step of providing an alarm message on a display of said printing device.

13. The method of claim 11, wherein said step of providing the indication that the ink delivery system has an ink leak further comprises the step of providing an alarm message on a display connected to said printing device.

14. A method of detecting an ink leak in an inkjet printing device, having an ink delivery system for delivering ink from ink reservoir means to printing means and an ink collector, comprising the steps of:

a) conveying the ink leaked from the ink delivery system to the ink collector by an ink carrier;

b) sensing when ink is present in the ink collector:

c) providing an indication that the ink delivery system has the ink leak and d) stopping the printing device.

15. An inkjet printing device having a frame, a transversely moveable printhead carriage, carrying at least one inkjet printhead, subject to reciprocating movement on said frame, and ink supply reservoir means mounted on said frame, and flexible ink supply tubing for delivering ink from said ink reservoir means to said at least one inkjet printhead, said device further comprising an ink leakage detection system comprising:

a collecting unit that collects an ink leak from the flexible ink supply tubing;

an ink carrier that conveys the ink leak into the collecting unit; and a sensing circuit coupled to said collecting unit that detects said ink leak from said flexible ink supply tubing.

16. An inkjet printing device having a frame a transversely moveable printhead carriage, carrying at least one inkjet printhead, subject to reciprocating movement on said frame, and ink supply reservoir means mounted on said frame, and flexible tubing means for delivering ink from said ink reservoir means to said at least one inkjet printhead, said device further comprising an ink leakage detection system comprising:

collecting means that collects an ink leak from the ink supply tubing;

ink carrier means that conveys the ink leak into the collecting means; and sensing means coupled to said collecting means that detects said ink leak from said flexible ink supply tubing.

* * * * *